United States Patent [19]

Kinstler

[11] Patent Number: 5,005,306

[45] Date of Patent: Apr. 9, 1991

[54] ILLUMINATED VEHICLE SIGN

[76] Inventor: William G. Kinstler, 2 Buckingham Ct., Rockledge, Fla. 32955

[21] Appl. No.: 369,692

[22] Filed: Jun. 21, 1989

[51] Int. Cl.[5] ..... G09F 21/04

[52] U.S. Cl. ..... 40/591; 40/544; 40/600; 362/80; 362/84

[58] Field of Search ..... 40/544, 591, 600, 621; 362/80, 84, 398; 340/781

[56] References Cited

U.S. PATENT DOCUMENTS

| | | | |
|---|---|---|---|
| 3,093,919 | 6/1963 | Holtz | 40/621 |
| 3,192,377 | 6/1965 | Abolins | 362/80 |
| 4,443,832 | 4/1984 | Kanamori et al. | 362/84 |
| 4,466,208 | 8/1984 | Logan, Jr. et al. | 40/580 |
| 4,494,326 | 1/1985 | Kanamori | 40/544 |
| 4,603,065 | 7/1986 | Mori et al. | 40/544 |
| 4,645,970 | 2/1987 | Murphy | 40/544 |
| 4,663,874 | 5/1987 | Sano et al. | 40/600 |
| 4,787,163 | 11/1988 | Berg | 40/592 |

FOREIGN PATENT DOCUMENTS

| | | | |
|---|---|---|---|
| 2106297 | 4/1983 | United Kingdom | 40/591 |

*Primary Examiner*—Peter R. Brown

*Assistant Examiner*—Brian K. Green

*Attorney, Agent, or Firm*—William M. Hobby

[57] ABSTRACT

An illuminated vehicle display apparatus has a flexible electroluminescent panel having a front planar surface which directly generates illumination when excited by an alternating current. A thin flat flexible opaque shield has cutout areas to form designs therein and is attached over the electroluminescent panel planar surface so that portions of the panel are visible through the opaque shield so that indicia and graphic designs are defined by the visible electroluminescent light. A thin flexible magnetic sheet of material is attached over the rear surface of the electroluminescent panel for removably attaching the vehicle sign to the side of a vehicle. The electroluminescent panel has a pair of conductors coupled thereto and through a DC to AC converter and is attached to the vehicle battery, such as through the vehicle cigarette lighter. A pair of panels may be attached to both sides of the vehicle on the doors adjacent the door hinge so that the conductors pass through the hinged area and are attached to a common cigarette lighter plug for powering panels on each side of the vehicle simultaneously.

7 Claims, 1 Drawing Sheet

ILLUMINATED VEHICLE SIGN

BACKGROUND OF THE INVENTION

The present invention relates to an illuminated vehicle display and especially to a flexible electroluminescent panel removably attachable to the side of a vehicle.

Illuminated display panels and signs have been used for providing information and as decorative displays in advertising and are well known in the prior art. Typically, such devices include structural components used in combination with a light source such as one or more lightbulbs wherein the field of illumination covers the information or display to be illuminated and exposed for viewing. The prior art includes structures which incorporate the illumination source being directed onto the face of a display surface to facilitate viewing thereof. The source of illumination may also be built into the interior of the display structure to accomplish a form of backlighting. Electroluminescent lamps have been used and typically have an outwardly facing planar surface which directly generates and radiates illumination when excited by an alternating current at a predetermined potential. Such lamps may include a light permeable electrode layer and a rear electrode layer with a luminescent layer interposed between the light permeable electrode layer and the rear electrode so that when an alternating current is applied to the electrode layers, the entire panel produces a soft light.

Prior U.S. patents can be seen in the Barlow Pat. No. 4,637,148 for an electroluminescent light formed into a badge that a person can wear and has means for a battery operated electronic DC to AC inverter and flashing circuit. The Kanamori Patent No. 4,494,326 provides an electroluminescent display formed into a motor vehicle window to continuous illuminate a vehicle manufacturer's emblem type or model of vehicle as desired. In the Munoz Pat. No. 4,475,298, an illuminated display plate may be attached to the front of a vehicle and has an illumination source with an opaque shield forming indicia. The Phillips, Jr. U.S. Pat. No. 4,457,089 is a decorative aluminum auto reflector, while the Flannery Pat. No. 3,921,324 is an illuminated license plate for vehicles which uses light tubes for rear lighting the license plate to define the indicia.

It has also been common in the past to provide a magnetic sign for attachment to the side of a vehicle and these magnetic signs are commonly made of a flexible thermoplastic polymer material which is impregnated with magnetic materials.

The present invention relates to an electroluminescent display or sign for attachment to one or both doors of the body of a vehicle for displaying advertising material or the like at night during low light periods to allow a better visibility of the advertising material. The displays can be rapidly attached and removed from the vehicle with the wiring passing inconspicuously between the edge of the door and the vehicle body and can be connected to the vehicle power through the cigarette lighter receptacle. An electroluminescent display panel and magnetic attaching means are flexible for quickly attaching to the side of a vehicle without damaging the paint or surface of the vehicle.

SUMMARY OF THE INVENTION

The present invention relates to an illuminated vehicle display sign for rapidly attaching to the exterior side of a vehicle and includes a flexible electroluminescent panel having a front planar surface which directly generates illumination when excited by an alternating current. The electroluminescent panel also has a rear opaque surface, a thin flat flexible opaque shield has predetermined cutout areas to form designs, such as indicia or graphics therein, and is attached over the electroluminescent panel planar surface so that portions of the electroluminescent panel are visible through the opaque shield whereby indicia and graphic designs are defined with a visible electroluminescent light. A flexible flat magnetic material is attached to the rear opaque surface of the electroluminescent panel for removably attaching an electroluminescent panel to the vehicle body without damage to the coating of the vehicle body. A circuit includes a pair of conductors attached to the electroluminescent panel and to a DC to AC inverter for converting the vehicle battery current to an alternating current. The DC to AC inverter has coupling means for removably connecting a pair of conductors between the DC to AC inverter and the vehicle battery circuit which includes a cigarette lighter plug which can plug directly into the cigarette lighter receptacle for quick attachment or removal of the illuminated vehicle sign. The coupling means may include a cigarette lighter plug having a pair of additional wires attached thereto for coupling a pair of electroluminescent panels to the vehicle battery circuit simultaneously so that an illuminated vehicle display can be placed on a pair of vehicle doors simultaneously. A switch may be provided for manually switching the illuminated vehicle display signs on or off.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
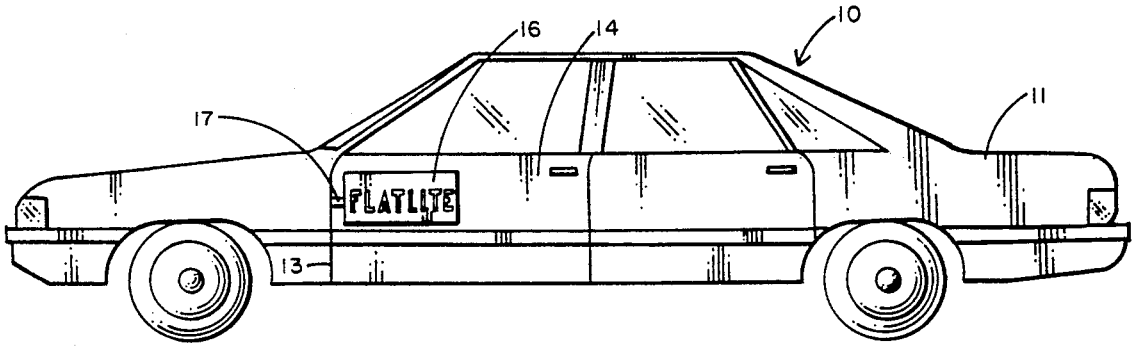
FIG. 1 is a side elevation of an automobile having an illuminated display in accordance with the present invention attached thereto.
Figure 2:
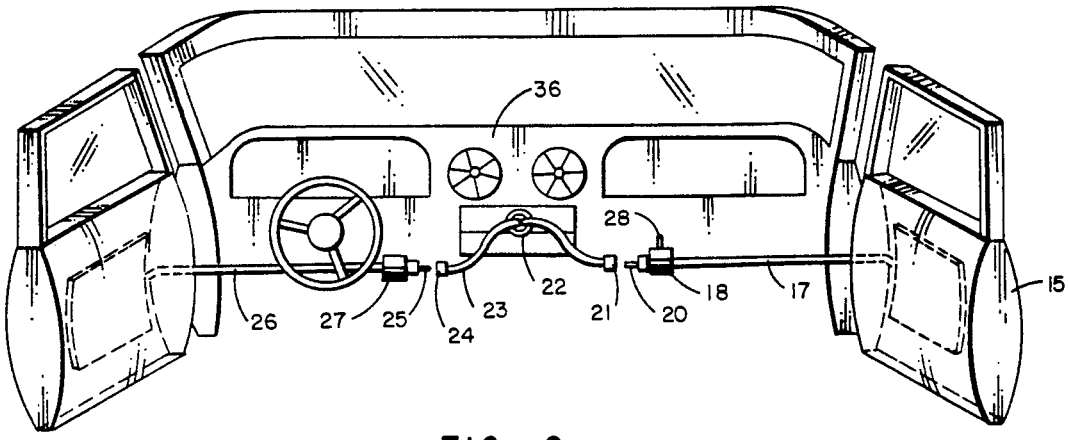
FIG. 2 is a partial sectional view of the vehicle showing a pair of illuminated display panels coupled through the cigarette lighter.

Referring to the drawings and especially to FIGS. 1 and 2, a vehicle 10 has a vehicle body 11, a pair of front doors 12 having a hinged area 13. The vehicle has a plurality of wheels 14. A second door 15 can be seen in FIG. 2. An illuminated vehicle display sign 16 is shown attached to the side of the door 12 having an electrical conductor 17 extending therefrom and through the hinged area 13 of the door 12. The display panel 16 is held to the door 12 with a flexible thermoplastic polymer impregnated with a magnetic material attached to the inner surface of the panel 16 so that the panel 16 is magnetically held to the door 12. The flexible electroluminescent panel 16 is flexible as is the strip of magnetic material attached thereto so that the entire display 16 is flexible having a display on one side and a magnetic attaching panel on the other side of the panel 16.

As seen in FIG. 2, the conductor 17 has a DC to AC inverter circuit 18 attached therein which attaches the DC battery current to an AC current for driving the electroluminescent panel. A connector plug 20 is also attached to the end of the conductor 17 and attaches to a matching coupler 21 which in turn is attached to a cigarette lighter or plug 22. A second conductor 23 is connected to the cigarette plug 22 and to a coupler 24 which in turn can be rapidly attached to the plug 25 and a second conductor 26 which is connected to a second electroluminescent panel. A second DC to AC inverter 27 is attached in the conductor 26.

Thus, the electroluminescent display panel 16 can be placed on the side of a door, as shown in FIG. 1, and is held there by the magnetic material adhesively or otherwise attached to the back of the electroluminescent panel and the conductors 17 run between the hinged area 13 between the door 12 and the body 11 of the vehicle 10 and the plug 20 plugged into the connector 21. The cigarette lighter plug 22 is plugged into the cigarette lighter receptacle for lighting the display 16. A switch 28 may also be provided for switching the panel lights on and off even through, in the embodiments of FIGS. 1 and 2, this can be as easily accomplished by coupling and uncoupling the plug 20 from the receptacle 21 or by removing the cigarette lighter plug 22 from the cigarette lighter receptacle.

Figure 4:
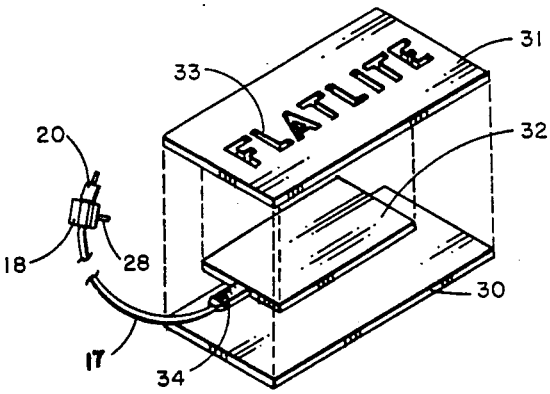
FIG. 4 is a perspective view of a display panel in accordance with the present invention.
Figure 3:
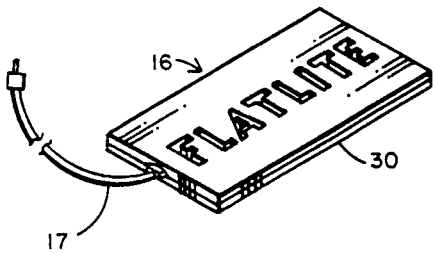
FIG. 3 is an exploded perspective view of a display panel in accordance with the present invention.

FIGS. 3 and 4 illustrate the electroluminescent panel 16 having a flexible magnetic panel 30 adhesively attached to the bottom thereof and a flat flexible opaque panel 31 attached to the top of the electroluminescent panel 32. The panels may be attached in any way desired, such as adhesively, with the magnetic surface 30 attached to one side of the electroluminescent panel 32 with the opaque indicia and graphics forming panel 31 attached to the other side of the panel 32. The panel 31 has cutout surfaces 33 which form indicia and graphics therethrough so that the light from the electroluminescent panel 32 is visible through the opaque panel 31 to form lighted indicia and designs on the display sign 16. The conductors 17 are connected to couplers 34 which are connected to the panel 32. The panel 32 is a standard electroluminescent panel and has a light permeable electrode layer on one side with a rear electrode layer on the other and an luminescent layer interposed between the electrodes. All three layers are made of flexible material to allow the entire display 16 including the electroluminescent panel 32, the magnetic panel 30, and the opaque covering panel 31 to all be flexed for attaching to the side of a vehicle door 12 or the like without damaging the surface coating of the vehicle. The conductor 17 has a DC to AC inverter 18 attached in the circuit adjacent the plug 20.

It should be clear at this time that an electroluminescent display sign has been provided for a quick attachment to a vehicle, such as an automobile, and for quick removal therefrom which provides a lighted display for the sides of the vehicle. However, it should also be clear that the wiring for the signs can be wired directly under the dash 36 of the vehicle so that the plugs 20 can be run under the dash and plugged directly into a mounted receptacle 21 without departing from the spirit and scope of the invention.

Accordingly, the present invention is not to be considered as limited to the forms shown which are to be considered illustrative rather than restrictive.

I claim:

1. An illuminated vehicle sign comprising:

a flexible electroluminescent panel having a front planar surface which directly generates illumination when excited by an alternating current and a rear opaque surface;

a thin, flat, flexible opaque shield having predetermined cutout areas to form designs therein attached over said flexible electroluminescent panel planar surface so that the flexible electroluminescent panel and attached flexible opaque shield form a flexible sign panel having portions of said electroluminescent panel visible through said opaque shield whereby indicia and graphic designs may be defined with visible electroluminescent light;

magnetic means attached to said rear opaque surface for removably attaching said electroluminescent panel to a vehicle body;

circuit means including a pair of conductors attached to said electroluminescent panel for applying an alternating current thereto and a DC to AC converter for converting said vehicle direct current to alternating current; and coupling means for removably connecting said pair of conductors of said circuit means between a vehicle battery circuit and to said DC to AC converter, said coupling means including a cigarette lighter plug attached to said circuit means conductors whereby said cigarette lighter plug can be attached or removed to connect or disconnect the vehicle power to said electroluminescent panel, whereby an illuminated vehicle sign can be quickly attached and removed from the side of the vehicle.

2. The illuminated vehicle sign in accordance with claim 1 in which said magnetic means is a flexible flat magnetic surface attached to said rear opaque surface of said electroluminescent panel.

3. The illuminated vehicle sign in accordance with claim 2 in which said flexible flat magnetic surface is formed of a polymer material.

4. The illuminated vehicle sign in accordance with claim 3 in which said flexible flat magnetic surface is the same general size as said rear opaque surface of said electroluminescent panel.

5. The illuminated vehicle sign in accordance with claim 3 in which said flexible flat magnetic surface is adhesively attached to said rear opaque surface of said electroluminescent panel.

6. The illuminated vehicle sign in accordance with claim 3 in which said circuit means includes a switch for connecting and disconnecting the vehicle battery to said electroluminescent panel.

7. The illuminated vehicle sign in accordance with claim 3 in which said circuit means cigarette lighter plug includes a pair of connectors for connecting a pair of electroluminescent panels to said vehicle panel whereby an electroluminescent panel can be attached to a vehicle door on both sides of said vehicle at the same time.

* * * * *